US008944356B2

(12) United States Patent
Kuvaja

(10) Patent No.: US 8,944,356 B2
(45) Date of Patent: Feb. 3, 2015

(54) FASTENING DEVICE, A CONE CRUSHER AND A METHOD FOR FASTENING AN INNER CRUSHING BLADE TO A HEAD OF A CONE CRUSHER

(75) Inventor: Kari Kuvaja, Tampere (FI)

(73) Assignee: Metso Minerals Inc., Helsinki (FI)

( * ) Notice: Subject to any disclaimer, the term of this patent is extended or adjusted under 35 U.S.C. 154(b) by 631 days.

(21) Appl. No.: 13/132,026

(22) PCT Filed: Jan. 29, 2009

(86) PCT No.: PCT/FI2009/050071

§ 371 (c)(1),
(2), (4) Date: Jun. 6, 2011

(87) PCT Pub. No.: WO2010/086488

PCT Pub. Date: Aug. 5, 2010

(65) Prior Publication Data

US 2011/0309176 A1 Dec. 22, 2011

(51) Int. Cl.

| | |
|---|---|
| ***B02C 17/08*** | (2006.01) |
| ***B02C 15/10*** | (2006.01) |
| ***B02C 2/00*** | (2006.01) |
| ***B02C 2/04*** | (2006.01) |

(52) U.S. Cl.
CPC .. *B02C 2/005* (2013.01); *B02C 2/04* (2013.01)
USPC ..... 241/207; 241/215; 241/30

(58) Field of Classification Search
USPC ..... 241/207, 208, 209, 210, 211, 212, 213, 241/214, 215, 216, 259, 259.1, 293; 403/31
See application file for complete search history.

(56) References Cited

U.S. PATENT DOCUMENTS

| | | | | |
|---|---|---|---|---|
| 3,666,188 | A * | 5/1972 | Lippmann | 241/213 |
| 3,754,716 | A * | 8/1973 | Webster | 241/208 |
| 4,391,414 | A * | 7/1983 | Reiter | 241/213 |
| 4,697,745 | A * | 10/1987 | Sawant et al. | 241/30 |
| 5,820,045 | A * | 10/1998 | Karra | 241/207 |
| 5,850,978 | A * | 12/1998 | Jacobson | 241/215 |
| 5,875,981 | A | 3/1999 | Ganser, IV et al. | |
| 6,299,083 | B1 * | 10/2001 | Polinski et al. | 241/207 |
| 7,823,820 | B2 * | 11/2010 | Eriksson et al. | 241/207 |
| 8,033,491 | B2 * | 10/2011 | Solomon et al. | 241/209 |
| 2004/0208710 | A1 * | 10/2004 | Shreider et al. | 405/267 |
| 2006/0144979 | A1 * | 7/2006 | Nieminen et al. | 241/259 |
| 2008/0290200 | A1 | 11/2008 | Eriksson et al. | |

FOREIGN PATENT DOCUMENTS

| | | |
|---|---|---|
| CN | 1176849 A | 3/1998 |
| CN | 2445808 Y | 9/2001 |

(Continued)

OTHER PUBLICATIONS

Translation of Chinese Office Action issued in Chinese Patent Application No. 200980155750.3 dated May 2, 2013.
International Search Report in International Application No. PCT/FI2009/050071; dated Oct. 8, 2009.

(Continued)

*Primary Examiner* — Shelley Self
*Assistant Examiner* — Homer Boyer
(74) *Attorney, Agent, or Firm* — Oliff PLC

(57) ABSTRACT

The fastening of a mantel to a head of a cone crusher with a fastening device. A first part of the fastening device is fastened to the head of the cone crusher. A second part of the fastening device is situated against the mantel and the second part is forced towards the first part with a tightening means.

11 Claims, 3 Drawing Sheets

(56) References Cited

FOREIGN PATENT DOCUMENTS

| | | | |
|---|---|---|---|
| CN | 1741854 | A | 3/2006 |
| FR | 2 298 368 | A1 | 8/1976 |
| SU | 507 356 | | 3/1976 |
| WO | WO 2008/140375 | A1 | 11/2008 |

OTHER PUBLICATIONS

International Preliminary Report on Patentability in International Application No. PCT/FI2009/050071; dated May 5, 2011.

Office Action issued in Chinese Patent Application No. 200980155750.3 dated May 19, 2014 (w/ translation).

* cited by examiner

FASTENING DEVICE, A CONE CRUSHER AND A METHOD FOR FASTENING AN INNER CRUSHING BLADE TO A HEAD OF A CONE CRUSHER

FIELD OF THE INVENTION

The present invention relates to a system for securing an inner crushing blade of a cone or gyratory crusher. Cone crushers and gyratory crushers are adapted for mine or quarry installations and serve for the reduction of the size of granulates and minerals to the dimensions required for their ultimate use.

BACKGROUND OF THE INVENTION

Typical cone crusher comprises a truncated conical crushing bowl, whose wall supports a fixed crushing blade, and a conical head bearing the inner crushing blade mounted on a shaft coaxial to the bowl. The geometrical axis of the conical head forms at the summit of the latter a certain angle with the axis of the principal shaft, which gives a nutatory movement to the head when the eccentric turns. During descent into the bowl, the materials are progressively crushed so as to reach the dimension of the smallest space between the fixed crushing blade and the inner crushing blade.

The inner crushing blade is mounted on the head and rests in its lower portion on the head, whilst it is fastened at its upper portion on the head by a screw, by means of a ring. This gripping is effected by a component of the gripping force of the screw directed along the generatrix of the cone of the inner crushing blade.

In the course of the crushing operation, the pieces which wear down most quickly are the crushing blades and particularly this inner crushing blade. Because of this, the inner crushing blade must be periodically changed due to wear.

To this end, it is fixed immovably on the head by means of the screw. This fastening of the screw requires a very high force so as to avoid the crushing blade knocking against the head. To fasten the blade, a key is generally used on which the operator taps with a sledgehammer. Moreover, in the course of operation, the inner crushing blade has the tendency to turn on the head but, with this movement, it drives the screw which self-locks while holding the crushing blade. The self locking of the screw ensures that disassembly also requires the application of a very high force. To facilitate disassembly, a ring is interposed, e.g. welded, between the screw head and the upper edge of the inner crushing blade. For disassembly, this ring is cut with a blowtorch and removed with a suitable tool, which frees the screw but which can then turn freely.

The prior art discloses also such solution where hydraulic power is applied in order to fasten the inner crushing blade on to the head of a crusher. In document FR 2298368 it is disclosed a cone crusher wherein the component forcing the inner crushing blade is moved towards the head by pressing it from its upper part by means of hydraulic cylinder. However, in this device the rotation of the piston in to which said component is attached has not been restrained and thus this device has disadvantage that it does not prevent the rotation of the inner crushing blade in respect of the head. An another drawback concerning to this solution is that this kind of fastening device requires that the adjusted pressure in the cylinder has to be maintained continuously since there is no other means in this type of device for keeping the said component in the position in which it fixes the inner crushing blade on to the head of the crusher.

Strong fastening is necessary to prevent the crushing blade from turning relative to the fastening screw head. There is a need for a sophisticated fastening solution than present solutions.

Summary of the Invention

Now, a fastening solution which requires less brutal power than the present solutions and which enables simple and advantageous solution for preventing rotation of the inner crushing with respect of the head of the crusher has been invented.

To achieve this aim, the fastening device according to the invention is primarily characterized in what will be presented in the independent claim 1. The cone crusher according to the invention is primarily characterized in what will be presented in the independent claim 6. The method according to the invention, in turn, is primarily characterized in what will be presented in the independent claim 11. The other, dependent claims will present some preferred embodiments of the invention.

In one embodiment of the invention, the idea is to fasten a crushing blade to a head of a cone crusher with a fastening device, a first part of which is fastened to the head of the cone crusher. A second part of the fastening device is situated against the crushing blade and the second part is forced towards the first part with a tightening means.

In another embodiment of the invention, the idea is to fasten a crushing blade to a head of a cone crusher with a fastening device, which device comprises a first part, a second part and a tightening means. The first part comprises fastening means for fastening the first part to the head. The second part comprises a contact area that is adjusted to be in contact with the crushing blade, and the second part is adjusted to be movable in relation to the first part. The tightening means are adjusted to move the second part along a linear path in relation to the first part.

In one embodiment of the invention the second part is forced towards the first part with hydraulic power.

In one embodiment of the invention the device comprises locking means to lock the first part to the second part.

In one embodiment of the invention the device comprises one or more retainers to prevent the relative rotation between the first part and the second part.

In one embodiment of the invention the tightening means comprises a cylinder formed in the first part, a piston that is adjusted inside the cylinder, and at least one pressure chamber between the cylinder and the piston, and the volume of the chamber can be adjusted.

In one embodiment of the invention the tightening means comprises a second pressure chamber between the cylinder and the piston, and the volume of the second pressure chamber can be adjusted in such a manner that increasing the volume of the chamber looses the contact between the crushing blade and the head.

In one embodiment of the invention the device comprises a conduit which extends from the cylinder to the upper surface of the first part.

In one embodiment of the invention the second part is forced towards the first part and then the second part is locked to the first part with the locking means.

Different embodiments and solutions of the fastening mechanism offer many different advantages. In one solution the mechanism is easy to fasten and lock. In one solution the mechanism is easy to open. It does not need a sledge hammer and/or welding and flame cutting equipment. In addition, the use of the solution needs less muscular strength than known solutions. In addition, the disclosed mechanism could be implemented into the crusher with many different kinds of blades and other structures.

Description of the Drawings

In the following, the invention will be described in more detail with reference to the appended principle drawings, in which.

For the sake of clarity, the figures only show the details necessary for understanding the invention. The structures and details that are not necessary for understanding the invention but are obvious for anyone skilled in the art have been omitted from the figures in order to emphasize the characteristics of the invention.

Detailed Description of the Invention

Figure 1:
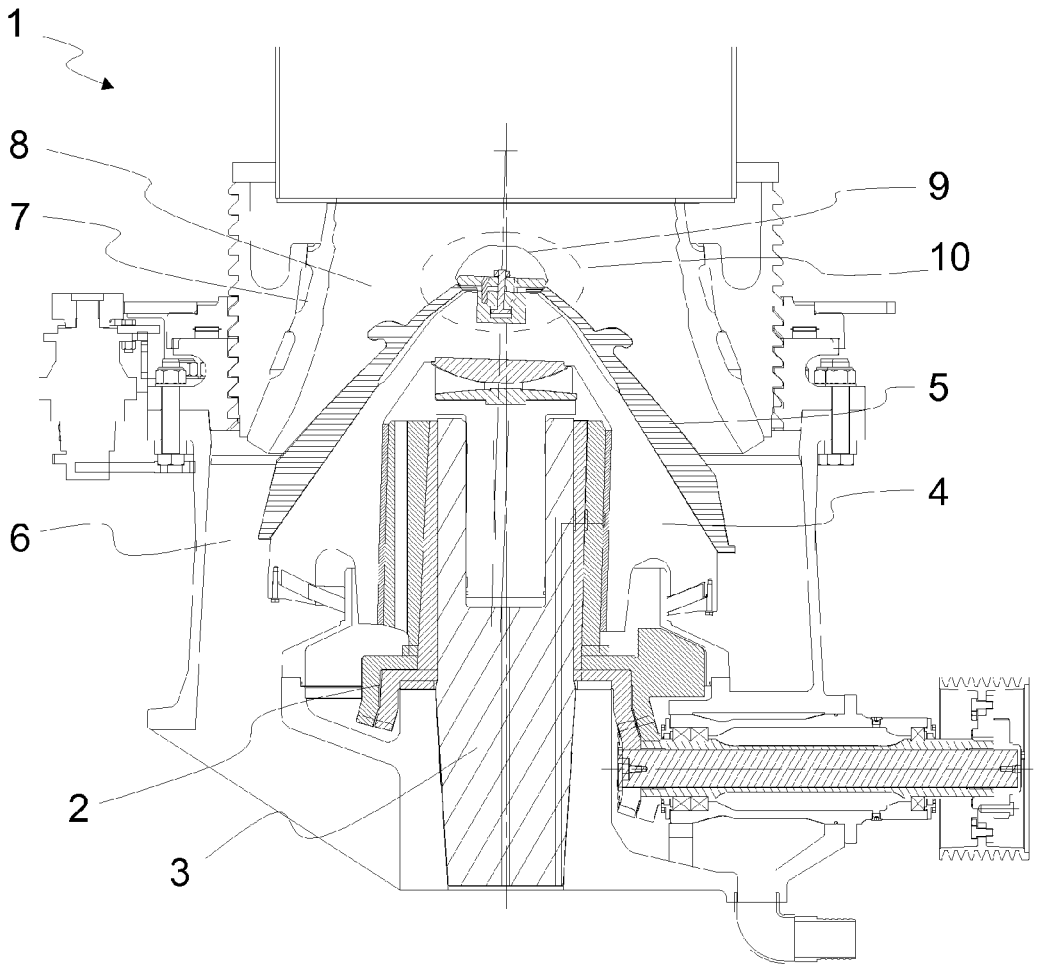
FIG. 1 shows a crushing unit of a cone crusher

A cone crusher unit 1 shown in FIG. 1 comprises a vertical eccentric shaft 2 and an oblique inner hole fitted therein. A main shaft 3 is fitted in the hole inside the eccentric shaft 2, and a head 4 (in other words a head) is often mounted on the main shaft 3. A means called an inner crushing blade 5 (in other words a mantel) and used as a wearing part has been mounted to the head 4. The head 4 is surrounded by the frame 6 of the crusher, on which has, in turn, been mounted a means called an outer crushing blade 7 and functioning as a wearing part. The inner and outer crushing blades 5, 7 together form a crushing chamber 8, in which the feed material is crushed. When the eccentric shaft 2 is rotated around the main shaft 3, the head 4 is entrained in an oscillating motion, wherein the gap between the inner crushing blade 5 and the outer crushing blade 7 varies at each point during the cycle. The smallest gap occurring during the cycle is called the setting S of the crusher, and the difference between the maximum and the minimum of the gap is called the stroke of the crusher. By the crusher setting S and the crusher stroke, as well as the operating speed of the crusher, it is possible, among other things, to influence the grain size distribution of the crushed material and the production capacity of the crusher.

In addition, there is a fastening device 10 for fastening the inner crushing blade 5 to the head 4 of a cone crusher 1. The structure of the fastening device 10 according to one embodiment is shown on a larger scale in FIG. 2. The fastening device 10 comprises a first part 11, a second part 12, a tightening means 13 and a locking means 14.

The first part 11 comprises a fastening means 15 for fastening the first part to the supporting cone 4. In this embodiment the fastening means 15 are thread-type means. The first part 11 can be screwed in to the head 4. In addition, the fastening means 15 can comprise one or more retainers 16, as for example, hexagonal, which keeps the first part 11 in place in relation to the second part 12 during the operation of the crusher. For example, if the inner crushing blade 5 moves in relation to the cone 4 during the operation, the combination of the first part 11 and the second part rotates in the threads. This rotation of the fastening means 10 fastens the inner crushing blade 5 to the head 4 more tightly. The retainers 16 can comprise, for example, a spline fastenable to the second part 12 around the upper section of the first part 11. One main idea of the retainers 16 being attached to the second part 12 is to prevent the relative rotation between the first part 11 and the second part 12.

Figure 3:
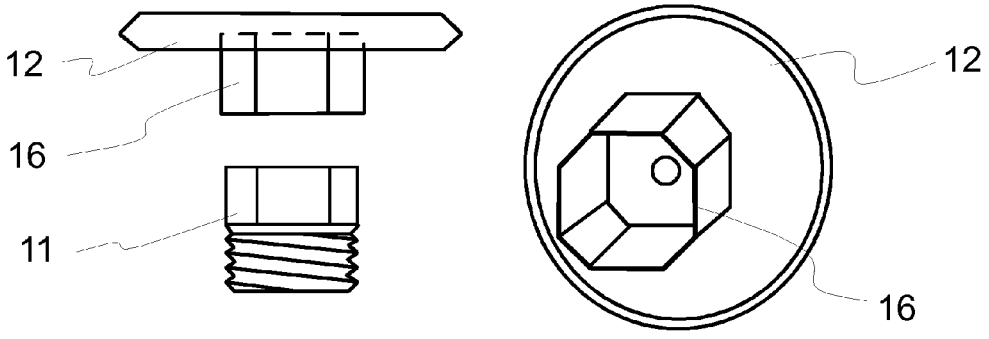
FIG. 3 shows an embodiment of a retainer

FIG. 3 shows an example of retainers 16 formed in the first part 11 and the second part 12. In this solution the retainer 16 is based on a hexagonal form. This kind of a retainer could be of some other form as well. For example, the form could be triangle, square or some other angular form. In addition, retainer could based on a elliptical form. The main idea of the form is that the first part 11 cannot rotate in relation to the second part.

The second part 12 comprises a contact area 17 that is adjusted to be in contact with the inner crushing blade 5. Advantageously, the second part 12 has means to prevent the rotation between the second part 12 and the inner crushing blade 5. In addition, the second part 12 is adjusted to be vertically (according to the central axis if the head 4) movable in relation to the first part 11. In this embodiment the second part 12 can be moved substantially in the direction of the axis of the head 4.

The tightening means 13 is adjusted to move the second part 12 along a linear path in relation to the first part 11. The direction of the path is substantially the same as the direction of the axis of the head 4.

The locking means 14 is adjusted to lock the first part 11 to the second part 12. In this embodiment bolts are used as the locking means 14. The number of the bolts or other locking means can vary depending on the solution.

In addition, a torch ring can be adapted into the system without the need to weld it.

Figure 2:
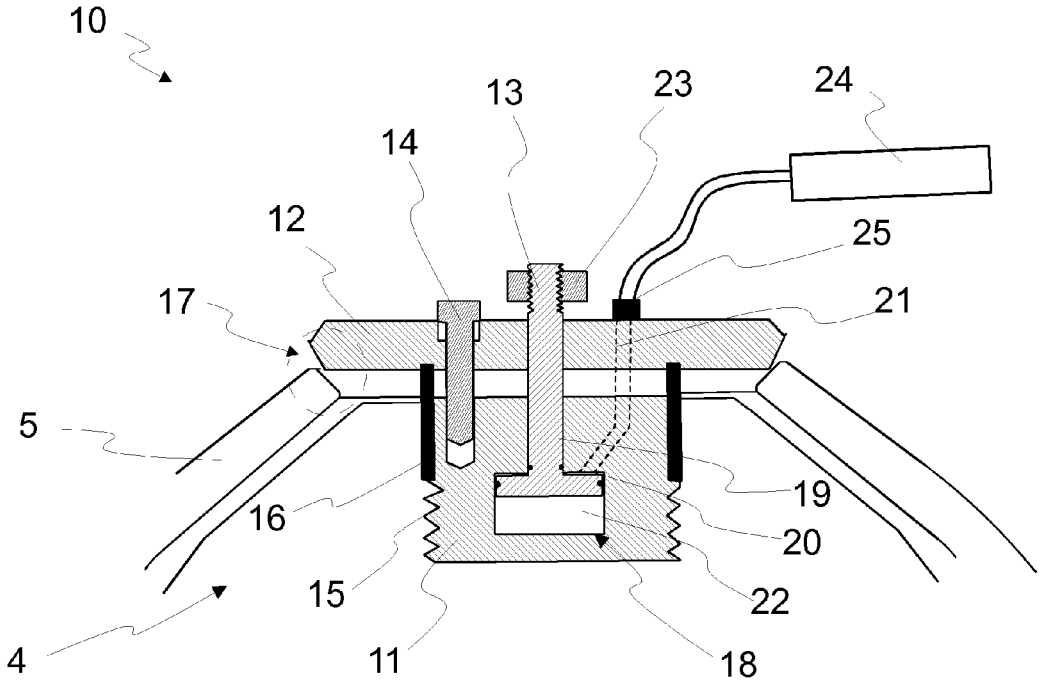
FIG. 2 shows a detail of FIG. 1

In the embodiment according to FIG. 2 the tightening means 13 comprises a cylinder 18 formed in the first part 11, a piston 19 that is inside the cylinder, and at least one pressure chamber 20 between the cylinder 18 and the piston 19, above the piston. The volume of the chamber 20 can be adjusted. Therefore, there is a conduit 21 (the first conduit) for transferring fluid. The fluid can be, for example, air, oil, grease, or other gas or liquid.

In the embodiment according to FIG. 2 there is also a second chamber 22. This chamber 22 is between the cylinder 18 and the piston 19, and to be exact, the second chamber is underneath the piston.

When fastening the inner crushing blade 5 to the operation position, the fastening device 10 is used as explained hereonbelow. After the inner crushing blade 5 has been placed onto the head 4, the first part 11 of the fastening means 10 with the tightening means 13 is inserted in the cone 4. The tightening means 13 is advantageously in its upper position. Then the second part 12 is located upon the first part 11 in such a manner that the arm of the tightening means 13 penetrates the second part. On the embodiment according to FIG. 2 a nut 23 in the arm of the tightening means 13 is used. The nut 23 is screwed on the arm's head, which has suitable threads. The nut 23 is some kind of a pre-tightening means. The pre-tightening means is used to tighten the crushing blade 5 in the first tightness level, which level is not necessarily tight enough for the operation of the crusher. Instead of the nut 23 or with the nut other solutions can also be used. In one embodiment a ring is used, which ring is welded on the arm of the tightening means 13.

In the next step the pressure of the first chamber 20 is raised. The pressure is developed advantageously with a pump 24, for example with a hydraulic pump. The pressure developer 24 can also be some other suitable device, for example, an oil injector. In one embodiment the pressure developer 24 is connected to a connector 25, which is on the upper surface of the second part 12.

The pressure in the first pressure chamber 20 forces the tightening means 13 and the second part 12 down toward the first part 11 and the head 4. At the same time the inner crushing blade 5 is pressed towards the head 4. By increasing the pressure in the chamber 20, the clearance between the inner crushing blade 5 and the cone 4 can be minimized. The tightening means 13 is used to tighten the inner crushing blade 5 in the tightness level, which level is tight enough for the operation of the crusher. After the tightening the pressure of the first pressure chamber 20 can be released. When the clearance is substantially removed, the position of the second part 12 of the fastening device is locked. In this embodiment the locking is done with the locking bolts 14. The locking bolts 14 fix the second part 12 to the first part 11.

When removing the inner crushing blade 5 the pressure in the first pressure chamber 20 is increased. Then the locking bolts 14 are removed. After that the pressure of the first pressure chamber 20 can be released. This kind of working makes the opening of the locking bolts 14 easier. In addition, the threads of the locking bolts 14 have a better possibility to be kept in good condition when opening the last bolts.

Figure 4:
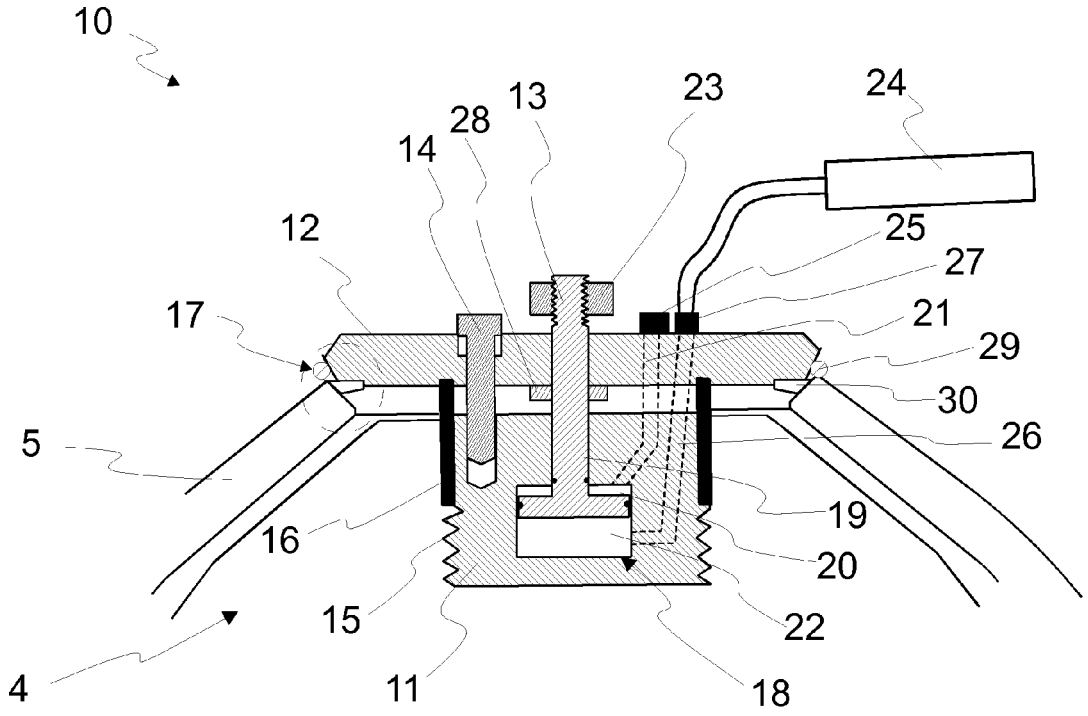
FIG. 4 shows another embodiment according to the invention

In the embodiment according to FIG. 4 the fastening means 10 comprises ejector means for helping the removing the inner crushing blade 5. In this solution the ejector means comprises a second pressure chamber 22, a second conduit 26, a second connector 27 and a pushing means 28. When removing the inner crushing blade 5 the locking bolts are removed first preferably as explained above. After that the second part 12 of the fastening device is removed as explained herein below. By increasing the pressure in the chamber 22, the piston 19 moves outward. The pressure is developed advantageously with a pump 24, for example with a hydraulic pump. In one embodiment the pressure developer 24 is connected to the second connector 27, which is on the upper surface of the second part 12. The pushing means 28 connected to the shaft of the piston 19 moves with the moving piston. In addition, the pushing means 28 pushes the second part 12 of the fastening device. As a result of the increasing pressure and the moving parts the second part 12 unfastens from the inner crushing blade 5 even if they were stuck. A more advantageous feature is to weld a torch ring, if used, to the second part 12 and to the inner crushing blade 5 before removing the second part. This makes it easier to unfasten the inner crushing blade 5 from the head 4 if they are fastened to each other too tight.

In addition, FIG. 4 shows a torch ring 29 and one example of the means 30 to prevent the relative rotation between the second part 12 and the inner crushing blade 5. Said means 30 is preferably at least one pin on the surface of the crushing blade 5, which can be incorporated to the corresponding hole or groove on the surface of the second part 12.

In the operation of the crusher the fastening device could be covered with a cover 9, as shown in FIG. 1.

By combining, in various ways, the modes and structures disclosed in connection with the different embodiments of the invention presented above, it is possible to produce various embodiments of the invention in accordance with the spirit of the invention. Therefore, the above-presented examples must not be interpreted as restrictive to the invention, but the embodiments of the invention may be freely varied within the scope of the inventive features presented in the claims herein below.

The invention claimed is:

1. A fastening device for fastening an inner crushing blade to a head of a cone crusher, comprising:

a first part that includes fastening means for fastening the first part to the head;

a second part that includes a contact area that is adjusted to be in contact with the crushing blade, the second part being adjustable to be movable in relation to the first part; and tightening means for moving the second part along a linear path in relation to the first part, the tightening means including a cylinder formed in the first part, a piston that is adjusted inside the cylinder, and at least one pressure chamber between the cylinder and the piston, a volume of the chamber being adjustable, wherein the fastening means further includes a retainer for preventing rotation of the second part with respect to the first part, the retainer being between the first part and the second part and being mainly symmetrical relative to a central axis of the head.

2. The fastening device according to claim 1, wherein the device comprises a locking means to lock the first part to the second part.

3. The fastening device according to claim 1, wherein the tightening means comprises a second pressure chamber between the cylinder and the piston, and the volume of the second pressure chamber can be adjusted in such a manner that increasing the volume of the chamber looses the contact between the crushing blade and the head.

4. The fastening device according to claim 1, wherein the device comprises at least one conduit which extends from the cylinder to the upper surface of the first part.

5. A cone crusher comprising a head;

a crushing blade mounted to the head;

a fastening device for fastening the crushing blade to the head, the fastening device including a first part that includes fastening means for fastening the first part to the head;

a second part that includes a contact area that is adjusted to be in contact with the crushing blade, the second part being adjustable to be movable in relation to the first part; and tightening means for moving the second part along a linear path in relation to the first part, the tightening means including a cylinder formed in the first part, a piston that is adjusted inside the cylinder, and at least one pressure chamber between the cylinder and the piston, a volume of the chamber being adjustable, wherein the fastening means further includes a retainer for preventing rotation of the second part with respect to the first part, the retainer being between the first part and the second part and being mainly symmetrical relative to a central axis of the head.

6. The crusher according to claim 5, wherein the device comprises a locking means to lock the first part to the second part.

7. The crusher according to claim 5, wherein the tightening means comprises a second pressure chamber between the cylinder and the piston, and a volume of the second pressure chamber can be adjusted in such a manner that increasing the volume of the second pressure chamber loosens the contact between the crushing blade and the head.

8. The crusher according to claim 6, wherein the device comprises at least one conduit which extends from the cylinder to the upper surface of the first part.

9. A method for fastening a crushing blade to a head of a cone crusher with a fastening device, the method comprising:

fastening a first part of the fastening device to the head of the cone crusher, situating a second part of the fastening device against the crushing blade, and forcing the second part towards the first part with tightening means, wherein rotation of the second part with respect to the first part is prevented by a retainer that is disposed between the first part and the second part, and that is mainly symmetrical relative to a central axis of the head, and wherein the second part is forced towards the first part with hydraulic power.

10. The method according to claim 9, wherein the second part is forced towards the first part and then the second part is locked to the first part with the locking means.

11. The method according to claim 9, wherein the second part is forced away from the first part with the tightening means when removing the crushing blade.

* * * * *